US009932828B2

(12) United States Patent
Iversen et al.

(10) Patent No.: US 9,932,828 B2
(45) Date of Patent: Apr. 3, 2018

(54) AXIAL PISTON MACHINE

(71) Applicant: Danfoss A/S, Nordborg (DK)

(72) Inventors: Frank Holm Iversen, Padborg (DK); Stig Kildegaard Andersen, Krusaa (DK)

(73) Assignee: Danfoss A/S, Nordborg (DK)

( * ) Notice: Subject to any disclaimer, the term of this patent is extended or adjusted under 35 U.S.C. 154(b) by 258 days.

(21) Appl. No.: 14/930,747

(22) Filed: Nov. 3, 2015

(65) Prior Publication Data

US 2016/0130944 A1 May 12, 2016

(30) Foreign Application Priority Data

Nov. 11, 2014 (EP) ..... 14192602

(51) Int. Cl.
*F01B 13/04* (2006.01)
*F01B 3/00* (2006.01)
*F04B 1/20* (2006.01)

(52) U.S. Cl.
CPC ..... *F01B 3/0023* (2013.01); *F04B 1/2092* (2013.01)

(58) Field of Classification Search
CPC .... F01B 3/0023; F01B 3/0032; F01B 3/0076; F04B 1/2092; F04B 1/12; F04B 1/126; F04B 1/20
USPC ..... 92/12.2, 70, 71
See application file for complete search history.

(56) References Cited

U.S. PATENT DOCUMENTS 3,183,848 A * 5/1965 Raymond ..... F04B 1/126 417/269
3,183,849 A * 5/1965 Raymond ..... F04B 1/126 417/270
3,267,871 A * 8/1966 Lee ..... F01B 3/0041 137/625.21
3,774,505 A * 11/1973 McLeod ..... F04B 1/20 91/506
6,217,289 B1 * 4/2001 Smith ..... F02M 59/06 417/199.1
6,405,634 B1 6/2002 Hansen
2003/0010195 A1 * 1/2003 Stolzer ..... F01B 3/0044 91/486

(Continued)

FOREIGN PATENT DOCUMENTS

CN 201292923 Y 8/2009
CN 102630279 A 8/2012

(Continued)

*Primary Examiner* — Thomas E Lazo
*Assistant Examiner* — Dustin T Nguyen
(74) *Attorney, Agent, or Firm* — McCormick, Paulding & Huber LLP

(57) ABSTRACT

An axial piston machine (1) is shown, comprising: a shaft (2) having an axis (3) of rotation, a cylinder drum (4) connected to said shaft (2) and having at least a cylinder (5) parallel to said axis (3) of rotation, a piston (6) movable in said cylinder (5), a swash plate (13), a slide shoe (11) pivotally mounted to said piston (6), and holding means holding said slide shoe (11) against said swash plate (13), said holding means having a pressure plate (14) and a number of coil springs (15) arranged between said cylinder drum (4) and said pressure plate (14). The object is to have a reliable operation of said machine with a simple construction. To this end each coil spring (15) is at least at one end fixed by a protrusion (20) extending into said coil spring (15).

17 Claims, 7 Drawing Sheets

(56) References Cited

U.S. PATENT DOCUMENTS

| | | | | |
|---|---|---|---|---|
| 2004/0042910 | A1* | 3/2004 | Gleasman | F04B 1/126 417/269 |
| 2006/0120881 | A1 | 6/2006 | Dantlgraber | |
| 2011/0030549 | A1* | 2/2011 | Mueller | F01B 3/0041 92/12.2 |
| 2013/0000481 | A1 | 1/2013 | Ohno | |

FOREIGN PATENT DOCUMENTS

| | | | |
|---|---|---|---|
| CN | 103459842 | A | 12/2013 |
| CN | 104685209 | A | 6/2015 |
| FR | 903 468 | A | 10/1945 |
| GB | 2 356 225 | A | 5/2001 |
| WO | 2014/156547 | A1 | 10/2014 |

* cited by examiner

AXIAL PISTON MACHINE

CROSS REFERENCE TO RELATED APPLICATIONS

Applicant hereby claims foreign priority benefits under U.S.C. § 119 from European Patent Application No. EP 14192602 filed on Nov. 11, 2014, the contents of which are incorporated by reference herein.

TECHNICAL FIELD

The present invention relates to an axial piston machine comprising: a shaft having an axis of rotation, a cylinder drum connected to said shaft and having at least a cylinder parallel to said axis of rotation, a piston moveable in said cylinder, a swash plate, a slide shoe pivotally mounted to said piston, and holding means holding said slide shoe against said swash plate, said holding means having a pressure plate and a number of coil springs arranged between said cylinder drum and said pressure plate.

BACKGROUND

The present invention relates in particular to a water hydraulic axial piston machine and preferably to a piston machine operating as a water pump.

When in such a water pump the shaft is rotatably driven, for example by an external motor, the cylinder drum rotates as well together with the cylinders and the piston accommodated in said cylinders. Since each piston has a slide shoe which is held in contact with the swash plate and the swash plate has a predetermined or variable angle relative to a normal plane to said axis of rotation, the rotational movement of the cylinder drum drives the pistons back and forth in a direction parallel to the axis of rotation. In order to achieve such a movement it is necessary to keep the slide shoes in contact with the swash plate. The pressure plate is used for that purpose. The pressure plate is loaded by a spring arrangement. The spring arrangement has a number of coil springs which are located within a guiding element having a number of through-going bores, one for each coil spring.

The pressure plate rests usually on a ball element having a bearing surface in form of a sphere. Theoretically, the rotational movement of the cylinder drum should produce a swiveling or pivoting movement of the pressure plate only and therefore the coil springs are loaded by axial forces only. However, in practice it can be observed that forces are generated acting laterally or in circumferential direction around the axis of rotation on the coil springs. This leads to the negative effect that the coil springs contact the guiding element and, after a certain time of operation, works into the guiding element so that a part of the coil spring length gets lost. Furthermore, there is a risk that the coil springs are damaged or broken.

SUMMARY

The object underlying the invention is to achieve a reliable operation of an axial piston machine with a simple construction.

This object is solved with an axial piston machine as described at the outset in that each coil spring is at least at one end fixed by a protrusion extending into said coil spring.

The coil spring now is guided internally by said protrusion. A risk that a protrusion is damaged by the coil spring is much smaller than the risk that a guiding element having a through-going bore to accommodate an end of the coil spring is damaged by the coil spring. The internal guiding of the coil spring prevents that the coil spring is tilted under the action of lateral forces or forces in circumferential direction around the axis of rotation.

Preferably said protrusions are located on a ring. This simplifies the construction. The coil springs can be assembled with the ring and the combination of ring and coil springs can be mounted in the machine.

Preferably said ring is guided against radial movement with respect to said axis of rotation. Such a guiding can be achieved by connecting the ring to the shaft or to a member connected to the shaft. No lateral or radial movement is possible. However, a small clearance is allowed to enable mounting of the ring into the machine.

In a preferred embodiment said pressure plate is supported by a ball element, said ring resting on a side of said ball element opposite said pressure plate. The ring has the additional purpose to prevent a direct contact between the ball element and the coil springs. Therefore, the coil springs cannot damage the ball element.

In a preferred embodiment said ring is made of a plastic material. Plastic material is usually softer than the material of the coil spring or the material of the ball element. The ring prevents wear of the coil springs and the ball element.

Preferably both ends of each coil spring are fixed by a protrusion. Preferably a ring carrying said protrusions is arranged at each of the ends of the coil springs. This simplifies mounting. The springs together with the two rings can be preassembled and then mounted into the machine.

Preferably said protrusion has a length corresponding to at least 20% of a length of said coil spring in an un-tensioned state. This means that the coil spring is guided by the protrusion over at least 40% of its total length. The remaining length is sufficient to allow for the compression or expansion of the coil spring in axial direction. However, deviation of the coil spring from the normal cylinder form is reliably prevented.

Preferably said protrusions have a conical form. This simplifies the mounting of the coil springs on the protrusions.

Preferably said protrusion has at its base an outer diameter corresponding to at least an inner diameter of said coil spring in an un-tensioned state. This means that the coil spring rests on said protrusion without a play.

In a preferred embodiment said outer diameter is larger than said inner diameter. The coil spring is mounted on the protrusion with a certain pretension. Mounting can be accomplished by pressing the coil spring axially on the protrusion. During such a loading of the coil spring the inner diameter of the coil spring usually increases so that the coil spring can easily be mounted on the protrusion.

Preferably said protrusion extends through an entire length of said coil spring and one end of said coil spring is moveable with respect to said protrusion parallel to the longitudinal extension of said protrusion. In this way it is possible to guide the entire length of the coil spring and to avoid a deflection of the coil spring.

In a preferred embodiment said protrusion is made of a metal, in particular steel. The risk that a contact between the coil spring and the protrusion damages the protrusion is decreased.

Preferably said protrusion has at least a nose extending from a circumferential surface of said protrusion. The nose has the purpose to hold a coil spring which has been mounted on the protrusion in position even if the ring is turned upside down. This is in particular useful when two rings are used. In this case the coil springs hold the two rings together so that the unit of coil springs and two rings can be handled as one piece.

Preferably at least one ring comprises a number of protrusions which is larger than the number of coil springs. The choice of the number of coil springs can be made depending on the kind and size of the machine. However, in a number of different machines the same ring or rings can be used.

Preferably a stabilization ring is located at least in an axial middle part of said coil spring. Such a stabilization ring may have a number of holes so that each coil spring can extend through the stabilization ring. The stabilization ring covers at least a middle part of the coil spring thereby decreasing the risk of a deflection of the coil springs.

BRIEF DESCRIPTION OF THE DRAWINGS

Preferred embodiments of the invention now will be described in more detail with reference to the drawing, wherein.

DETAILED DESCRIPTION

Figure 1:
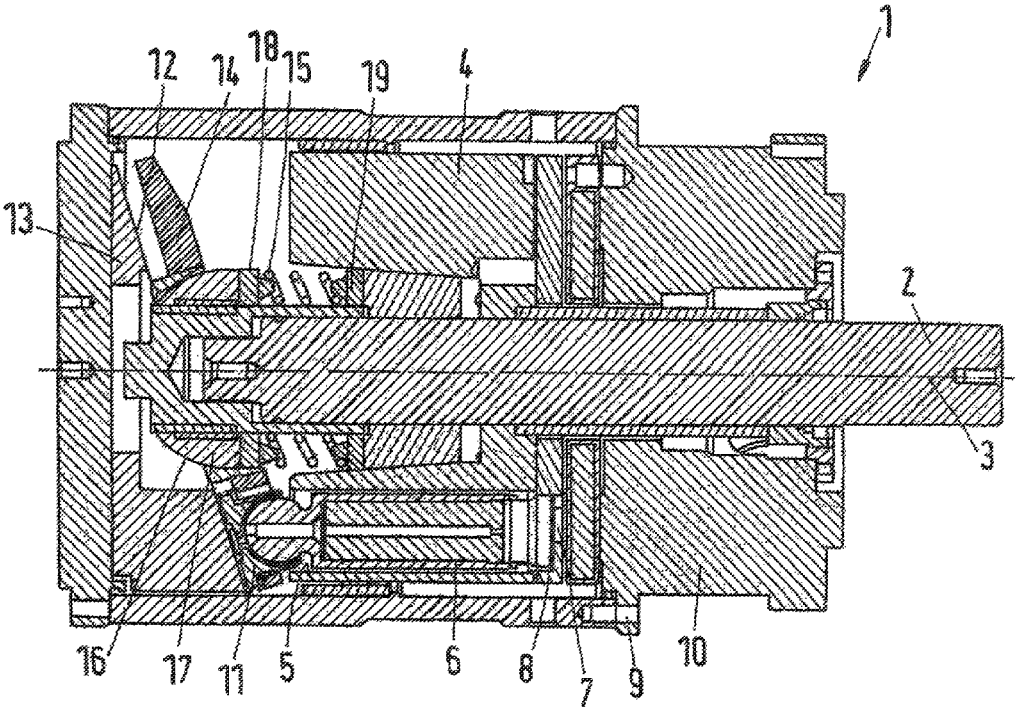
FIG. 1 is a schematic sectional view of an axial piston machine.

FIG. 1 schematically shows an axial piston machine 1 in form of a water hydraulic pump. The machine 1 comprises a shaft 2 having a rotational axis 3. The shaft 2 can be connected to a motor, for example an electrical motor, wherein the motor rotates the shaft.

A cylinder drum 4 is connected to said shaft 2 in rotational direction so that the cylinder drum 4 rotates together with the shaft 2 when shaft 2 rotates.

A plurality of cylinders 5 (one shown only) is arranged within said cylinder drum 4. The cylinders 5 each have an axis parallel to said axis 3 of rotation.

A piston 6 is slidably arranged in said cylinder 5.

Each cylinder 5 is connected to an opening 7 in a port plate 8. The port plate 8 rests against a valve plate 9 as it is known in the art. The valve plate 9 establishes a connection between the rotating cylinders 5 and a port housing 10 comprising inlet and outlet ports (not shown).

Each piston 6 has at its end facing away from said port plate 10 a slide shoe 11. The slide shoe 11 rests against a driving surface 12 of a swash plate 13.

In order to hold the slide shoe 11 in contact with the driving surface 12 holding means are provided having a pressure plate 14 and a number of coil springs 15 which are arranged between said pressure plate 14 and said cylinder drum 4.

The pressure plate bears on a spherical surface 16 of a ball element 17. The coil springs act on said ball element 17 thereby pressing the pressure plate 14 in a direction towards said swash plate 13 and keeping the slight shoe 11 in contact with the driving surface 12. When the shaft 2 is rotated, the slide shoes 11 have to follow the driving surface 12 so that the pistons 6 are moved forth and back in the cylinders 5.

FIGS. 2 to 5 show more details of the mounting of the coil springs 15.

The coil springs 15 are located between two rings 18, 19. The rings 18, 19 are made of plastic material.

Each ring has a number of protrusions 20. The protrusions 20 have a slightly conical form. In the mounted state, the protrusions 20 extend into the coil springs 15.

Each protrusion 20 is provided with a nose 21 extending radially from a circumferential surface of the protrusion 20. When a coil spring 15 is mounted on a protrusion 20 and an axial pressure is exerted on the coil spring 15, the inner diameter of the coil spring 15 increases so that a winding in the region of the end of the coil spring 15 can be moved over the nose 21. After releasing the axial pressure on the coil spring 15 the winding of the coil spring 15 is held by form fit behind the nose 21. In this way the coil spring 15 can be secured against loss on the rings 18, 19.

Each protrusion 20 has an outer diameter being slightly larger than the inner diameter of the coil spring 15 in a non-tensioned state. This means that the coil spring 15 is held with a certain pretension on the protrusion 20.

Figure 5:
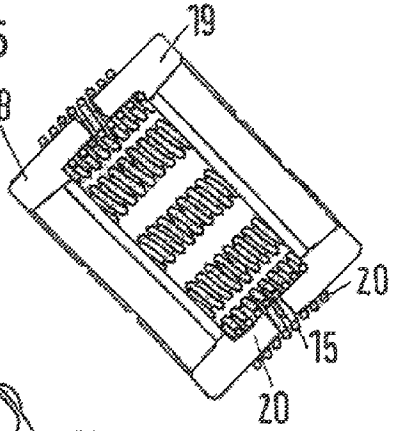
FIG. 5 is a section view V-V of FIG. 4.
Figure 4:
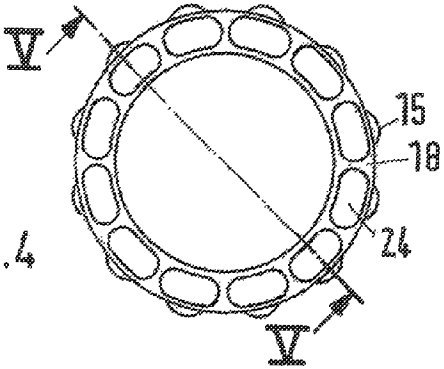
FIG. 4 is a bottom view of said spring unit.
Figure 3:
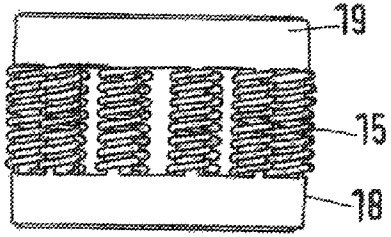
FIG. 3 is a side view of said spring unit.

As can be seen in particular in FIG. 5, each protrusion 20 extends into the coil spring 15 with a length corresponding to at least 20% of a length of said coil spring 15 in an un-tensioned state. The coil spring 15 is guided by the protrusions 20 over a considerable length.

It is not necessary that all protrusions 20 on a ring 18, 19 are equipped with a coil spring 15. It is possible to leave one or more of the protrusions 20 free of coil springs 15. This depends on the machine to be equipped with a package of rings 18, 19 and coil springs 15. The same rings 18,19 can be used for a plurality of different machines.

The coil springs 15 are machined at their axial ends to have an end surface perpendicular to the longitudinal axis of the coil springs 15. In other words, the coil springs 15 have ends 22 which are fully arranged within a plane. They can bear against a flat surface of the rings 18, 19 facing the coil springs 15.

During operation of the machine 1 the pressure plate 14 swivels around a pivot point or swivel defined by the spherical surface 16 of the ball element 17. Theoretically there should be no rotational movement of the pressure plate 14 and of the ball element 17. However, in practice such a rotational movement can be observed.

The use of the rings 18, 19 guiding internally the coil springs 15 has the advantage that the rings 18, 19 have a low friction with the ball element 17 so that lateral forces on the coil springs 15 can be kept small. Furthermore, since the coil springs 15 are guided by the protrusions 20 the risk of a lateral deformation of the coil springs bearing the risk of damaging the coil springs 15 is kept small as well. The rings 18, 19 are guided by the shaft 2 or by another element connected to said shaft 2 so that the rings 18, 19 are secured against a radial movement with respect of said axis 3 of rotation.

The rings 18, 19 have bearing pads 24 made of a plastic material having a low friction coefficient with the ball element 17. The bearing pads 24 can be made, for example, from PEEK.

It is of course possible to fix two or more pumps to the shaft 2. When, for example, two pumps are operated simultaneously, they can be arranged on opposite sides of the port housing 10.

Figure 6:
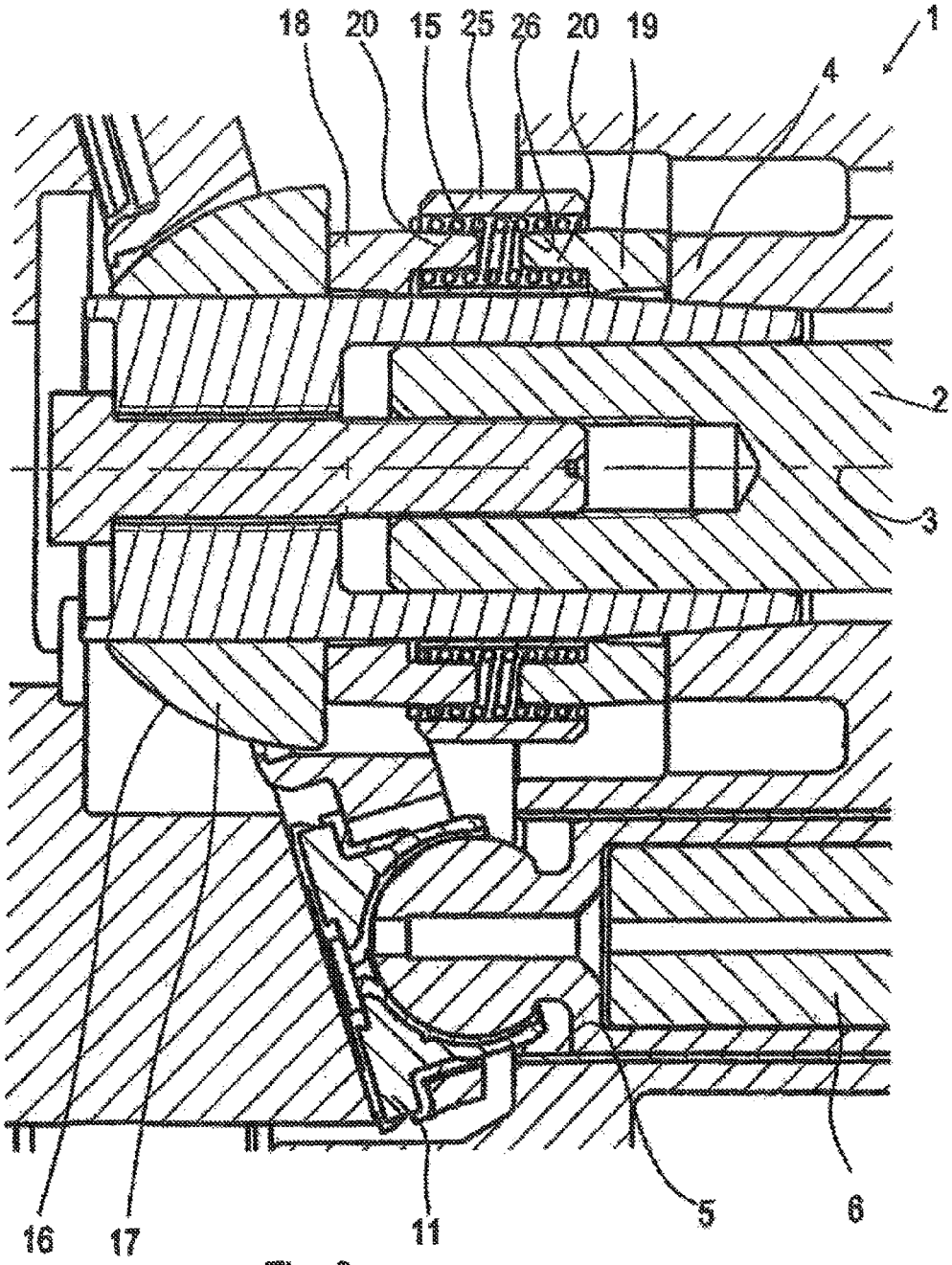
FIG. 6 is a detail of the second embodiment of an axial piston machine in an enlarged view.

FIG. 6 shows a detail of a second embodiment of an axial piston machine 1 in an enlarged view. Same elements as in FIGS. 1 to 5 are designated with the same reference numerals.

Compared to the embodiment shown in FIG. 1, the protrusions 20 have a greater length, i.e. they extend more into the coil spring 15.

Figure 7:
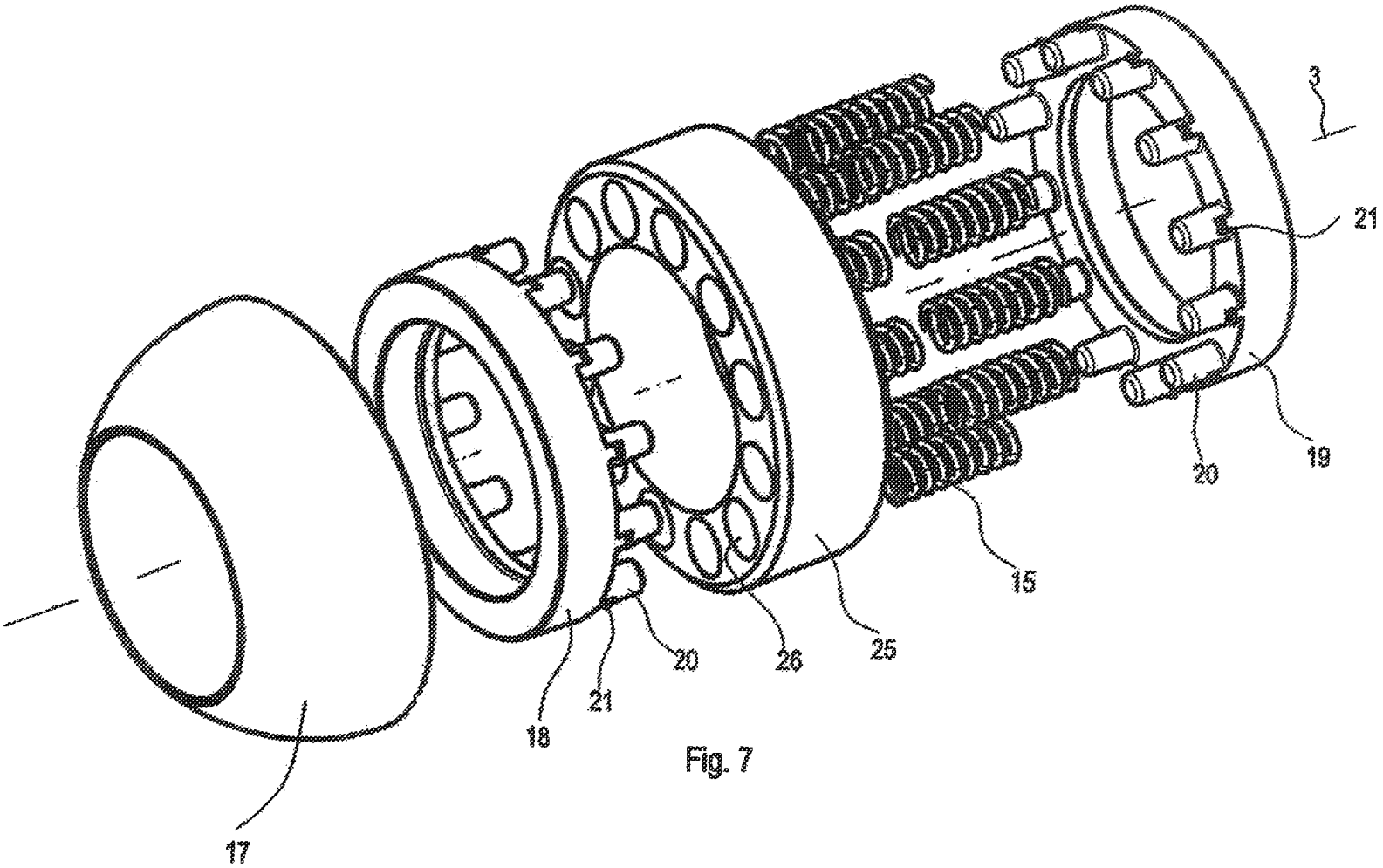
FIG. 7 shows a perspective exploded view of a modified spring unit.

Furthermore, a stabilization ring 25 is located at least in the axial middle region of the coil spring 15. In the present embodiment the stabilization ring 25 extends over the entire length of the coil spring 15. As can be seen in FIG. 7, the stabilization ring 25 has a number of through-going bores 26 so that each coil spring 15 can be inserted into the stabilization ring 25. The stabilization ring 25 is a further means to avoid a deflection of the coil springs 15.

Figure 8:
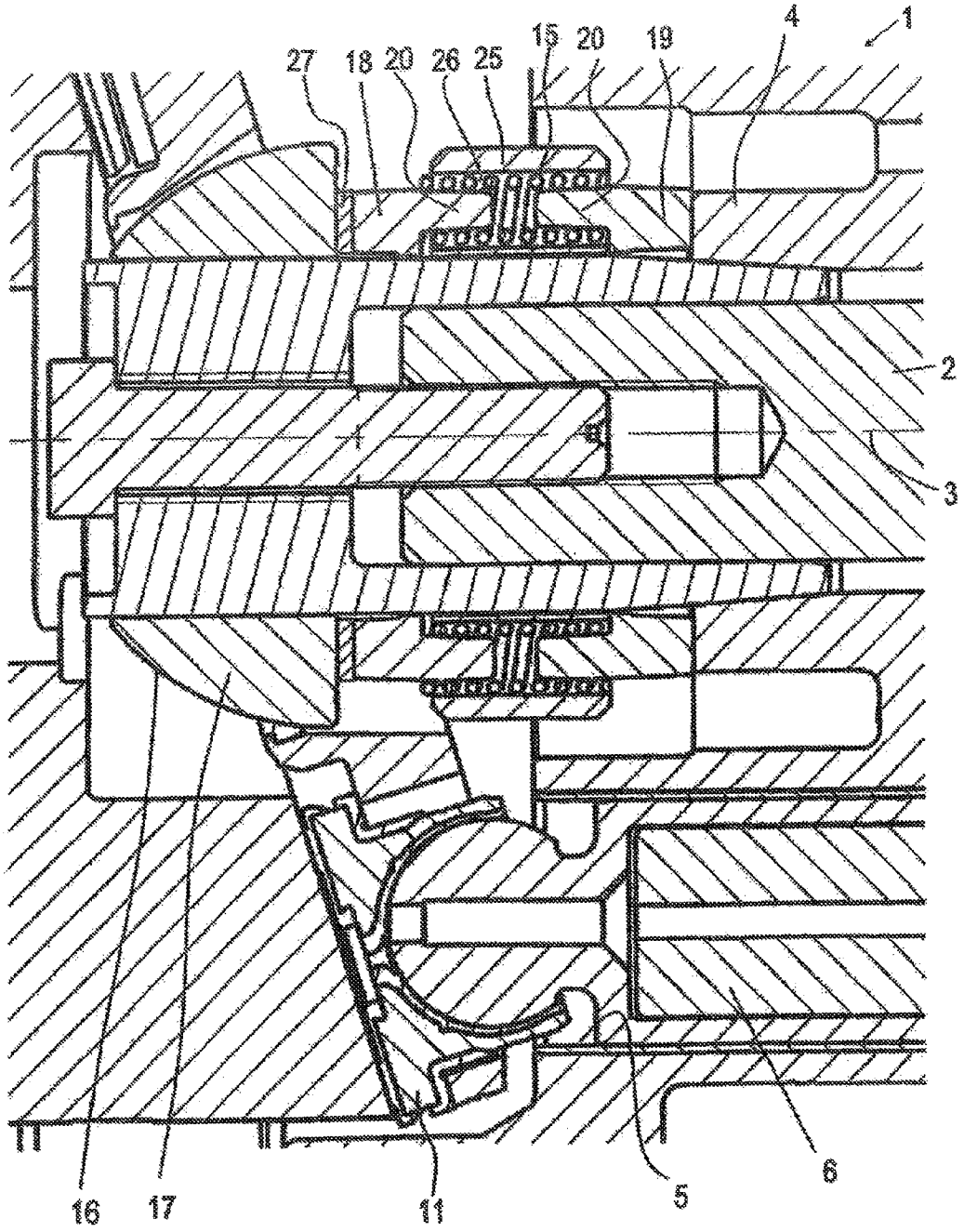
FIG. 8 shows a third embodiment in a view according to FIG. 6.

FIG. 8 shows a further embodiment which differs from that of FIG. 6 in that a ring shaped friction reducing disk 27 is located between the ring 18 and the ball element 17. The friction reducing disk 27 replaces the bearing pads 24 and can be made from the same material as the bearing pads 24, for example, from PEEK or any other plastic material having a friction reducing characteristic with steel.

Figure 9:
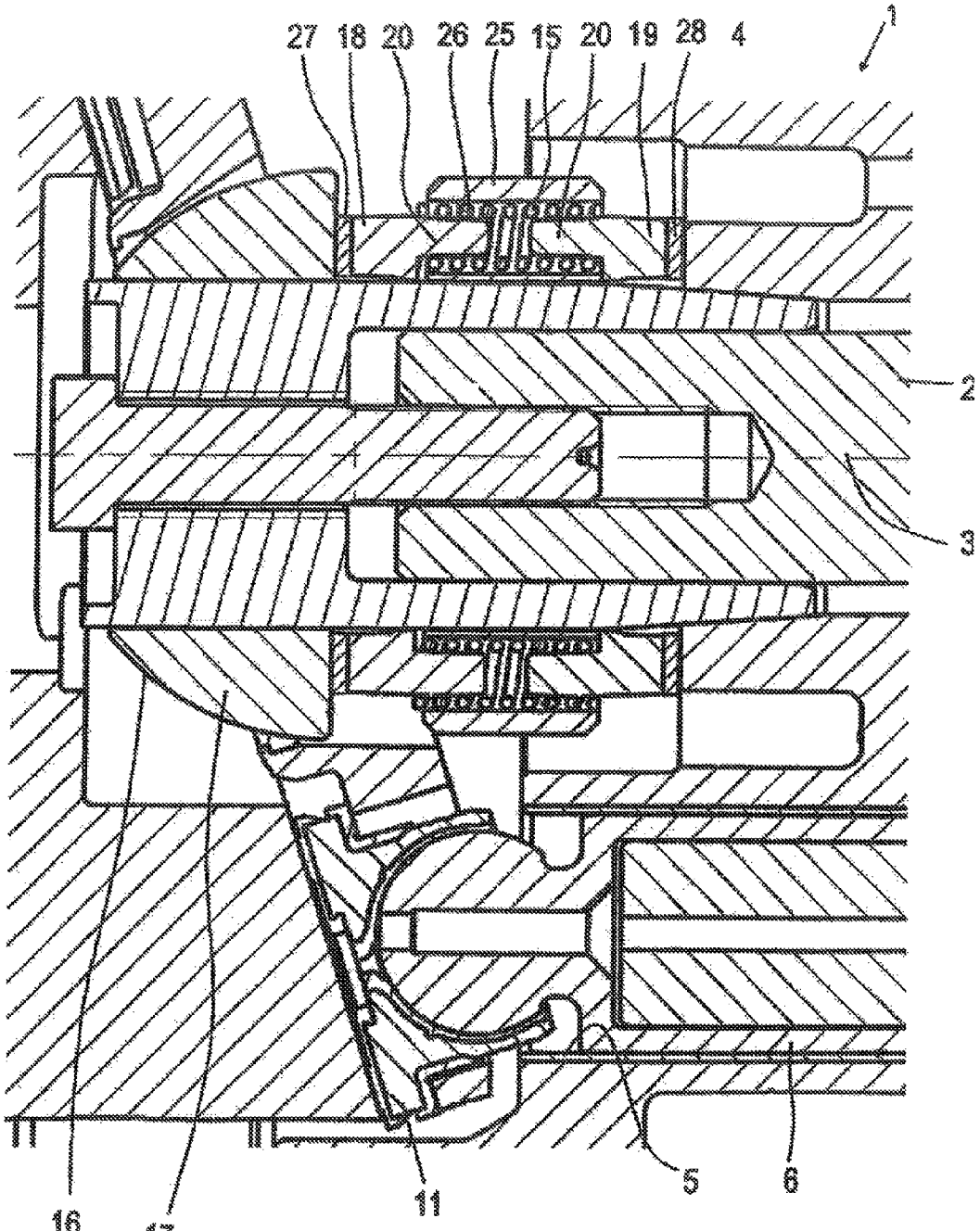
FIG. 9 shows a fourth embodiment in a view according to FIG. 6.

FIG. 9 shows a fourth embodiment differing from that shown in FIG. 8 in that a further ring shaped friction reducing disk 28 is located between the ring 19 and the cylinder drum 4. The friction reducing disk 28 has the same characteristics as the friction reducing disk 27. It can be made, for example, from PEEK as well.

Figure 2:
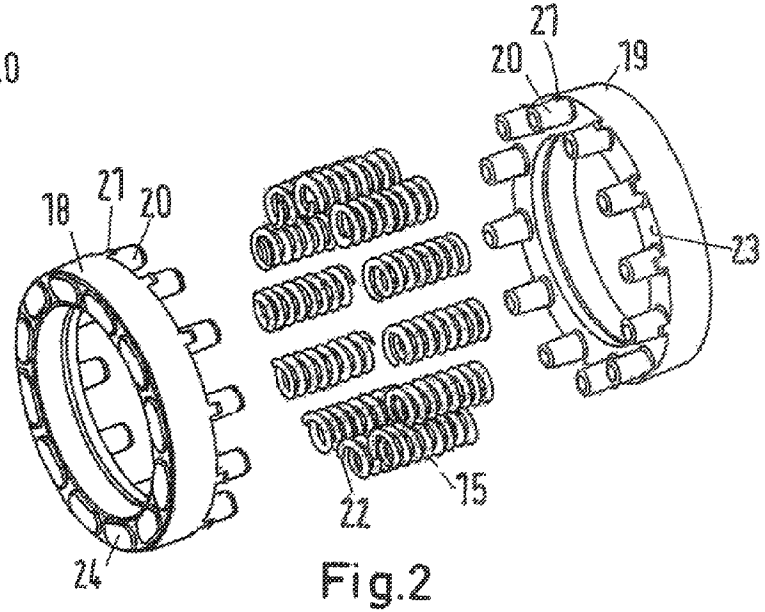
FIG. 2 is a perspective exploded view of a spring unit.
Figure 11:
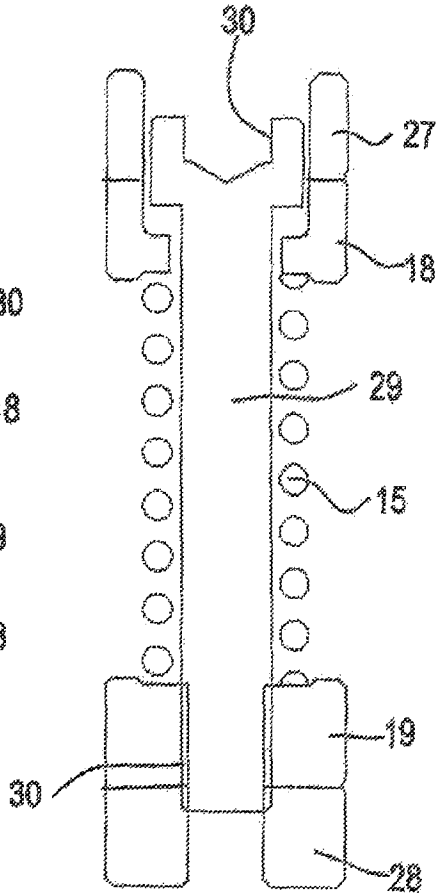
FIG. 11 shows a section through a coil spring having a modified protrusion.
Figure 10:
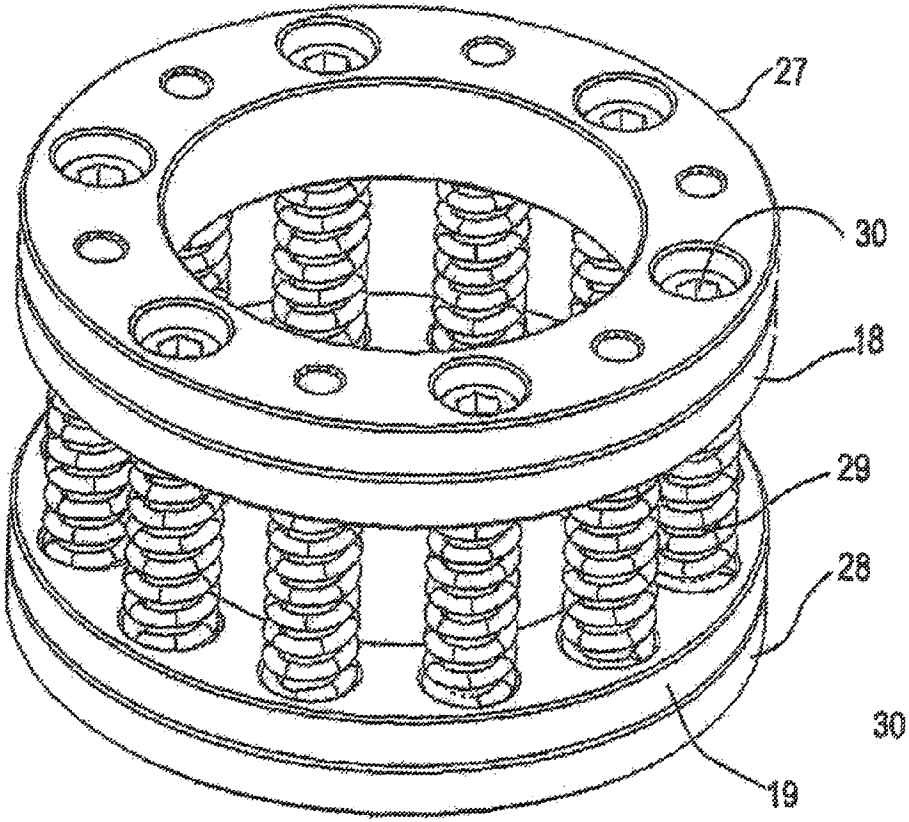
FIG. 10 shows a further embodiment of a spring unit in perspective view.

FIGS. 10 and 11 show another embodiment of a coil spring unit differing from that shown in FIGS. 2 and 7 in that the coil springs 15 are located around a through-going protrusion 29 which can be, for example, of steel. The steel protrusion 29 has a torque application geometry 30 at one end and a thread at the other end. The first end having the torque application geometry is not connected to ring 18 but is moveable in lengthwise direction with respect to ring 18 so that spring 15 can contract and expand to a sufficient extend.

As shown in FIG. 10, the rings 18, 19 can be equipped with friction reducing disks 27, 28.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. An axial piston machine comprising:
a shaft having an axis of rotation,
a cylinder drum connected to said shaft and having at least a cylinder parallel to said axis of rotation,
a piston movable in said cylinder,
a swash plate,
a slide shoe pivotally mounted to said piston, and
holding means holding said slide shoe against said swash plate,
said holding means having a pressure plate and a number of coil springs arranged between said cylinder drum and said pressure plate wherein both ends of each coil spring are fixed by protrusions extending into each coil spring, and
wherein the protrusions at at least one end of the coil spring are located on a ring.

2. The axial piston machine according to claim 1, wherein said ring is guided against radial movement with respect to said axis of rotation.

3. The axial piston machine according to claim 2, wherein said pressure plate is supported by a ball element, said ring resting on a side of said ball element.

4. The axial piston machine according to claim 2, wherein said ring is made of a plastic material.

5. The axial piston machine according to claim 1, wherein said pressure plate is supported by a ball element, said ring resting on a side of said ball element.

6. The axial piston machine according to claim 5, wherein said ring is made of a plastic material.

7. The axial piston machine according to claim 1, wherein said ring is made of a plastic material.

8. The axial piston machine according to claim 1, wherein said protrusion has a length corresponding to at least 20% of a length of said coil spring in an un-tensioned state.

9. The axial piston machine according to claim 1, wherein said protrusions have a conical form.

10. The axial piston machine according to claim 9, wherein said protrusions have at their base an outer diameter corresponding to at least an inner diameter of said coil spring in an un-tensioned state.

11. The axial piston machine according to claim 10, wherein said outer diameter is larger than said inner diameter.

12. The axial piston machine according to claim 1, wherein said protrusion extends through an entire length of said coil spring and one end of said coil spring is moveable with respect to said protrusion.

13. The axial piston machine according to claim 1, wherein said protrusion is made of a metal, in particular steel.

14. The axial piston machine according to claim 1, wherein said protrusion has at least a nose extending from a circumferential surface of said protrusion.

15. The axial piston machine according to claim 1, wherein the ring comprises a number of protrusions which is larger than the number or coil springs.

16. An axial piston machine comprising:
a shaft having an axis of rotation,
a cylinder drum connected to said shaft and having at least a cylinder parallel to said axis of rotation,
a piston movable in said cylinder,
a swash plate,
a slide shoe pivotally mounted to said piston, and
holding means holding said slide shoe against said swash plate,
said holding means having a pressure plate and a number of coil springs arranged between said cylinder drum and said pressure plate wherein each coil spring is at least at one end fixed by a protrusion extending into said coil spring, and
wherein a stabilization ring is located at least in an axial middle part of said coil springs.

17. An axial piston machine comprising:
a shaft having an axis of rotation,
a cylinder drum connected to said shaft and having at least a cylinder parallel to said axis of rotation,
a piston movable in said cylinder,
a swash plate,
a slide shoe pivotally mounted to said piston, and
holding means holding said slide shoe against said swash plate,
the holding means having a pressure plate and a number of coil springs arranged between said cylinder drum and the pressure plate wherein each end of each coil spring is fixed by protrusions extending into each coil spring, and wherein the protrusions are located on two separate rings.

* * * * *